United States Patent [19]

Dyar

[11] 4,426,819

[45] * Jan. 24, 1984

[54] THERMAL INSULATING SYSTEM PARTICULARLY ADAPTED FOR BUILDING CONSTRUCTION

[76] Inventor: Harrison G. Dyar, P.O. Box 185, Tampa, Fla. 33601

[ * ] Notice: The portion of the term of this patent subsequent to Jun. 15, 1999 has been disclaimed.

[21] Appl. No.: 374,473

[22] Filed: May 3, 1982

Related U.S. Application Data

[62] Division of Ser. No. 215,083, Dec. 10, 1980, Pat. No. 4,334,395.

[51] Int. Cl.[3] ..... E04B 1/78

[52] U.S. Cl. ..... 52/407; 52/791

[58] Field of Search ..... 267/51, 178, 53, 95, 267/104, 110, 168; 52/404, 406, 407, 577, 791; 248/563, 561, 573; 220/420–423, 445, 413, 415, 424, 425, 431, 435, 436–438

[56] References Cited

U.S. PATENT DOCUMENTS

| | | | |
|---|---|---|---|
| 1,866,517 | 7/1932 | Heylandt | 220/445 |
| 2,394,853 | 2/1946 | Goodard | 220/448 |
| 2,863,297 | 12/1958 | Johnston | 220/423 |
| 3,191,568 | 6/1965 | Schroeder | 220/448 |
| 3,311,249 | 3/1967 | Bell | 220/448 |
| 3,487,971 | 1/1970 | Kirgis | 220/463 |
| 3,794,203 | 2/1974 | Baumann | 220/415 |
| 4,184,609 | 1/1980 | Vorreiter | 220/423 |

FOREIGN PATENT DOCUMENTS

| | | | |
|---|---|---|---|
| 584660 | 10/1959 | Canada | 220/448 |
| 726176 | 5/1932 | France | 267/10 |
| 1249510 | 11/1960 | France | 220/448 |
| 54-47516 | 11/1979 | Japan | 220/439 |

*Primary Examiner*—John E. Murtagh

*Attorney, Agent, or Firm*—Diller, Ramik & Wight

[57] ABSTRACT

This disclosure relates to an insulating system which is particularly adapted for insulating the walls, floors, ceilings and like structure of buildings and includes a panel having a hollow chamber or interior under negative pressure (vacuum) and being of a variety of external peripheral sizes and shapes to fit within areas defined by wall and/or floor and/or ceiling studs, beams or the like, a plurality of springs, chains or the like for supporting the panel in generally spaced relationship to an associated building wall, ceiling, floor or like structure, and a plurality of pin-like elements of relatively small cross-sectional configuration normally spaced from the exterior surface of the panel for contacting a limited exterior surface area of the panel only upon the springs, chains or the like becoming inoperative which would in the absence of the pin-like elements result in direct contact between the panel and the associated building wall, ceiling, floor or like structure and thus reduce the insulating efficiency thereof.

6 Claims, 21 Drawing Figures

FIG.1
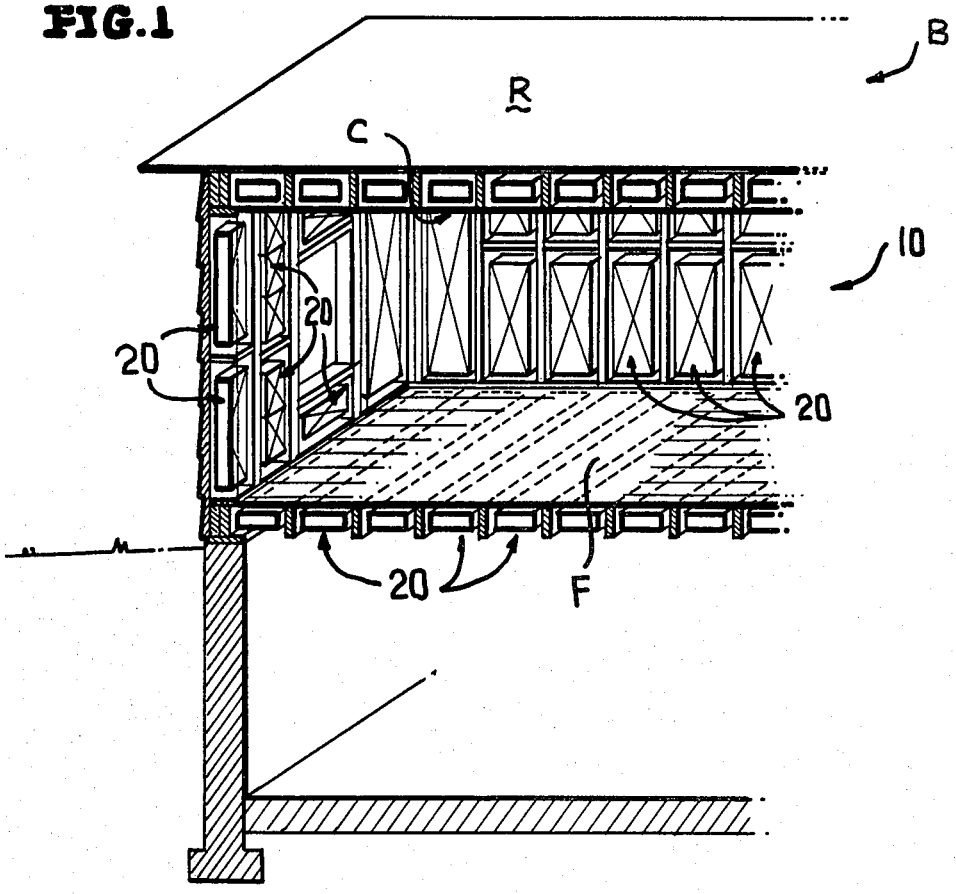
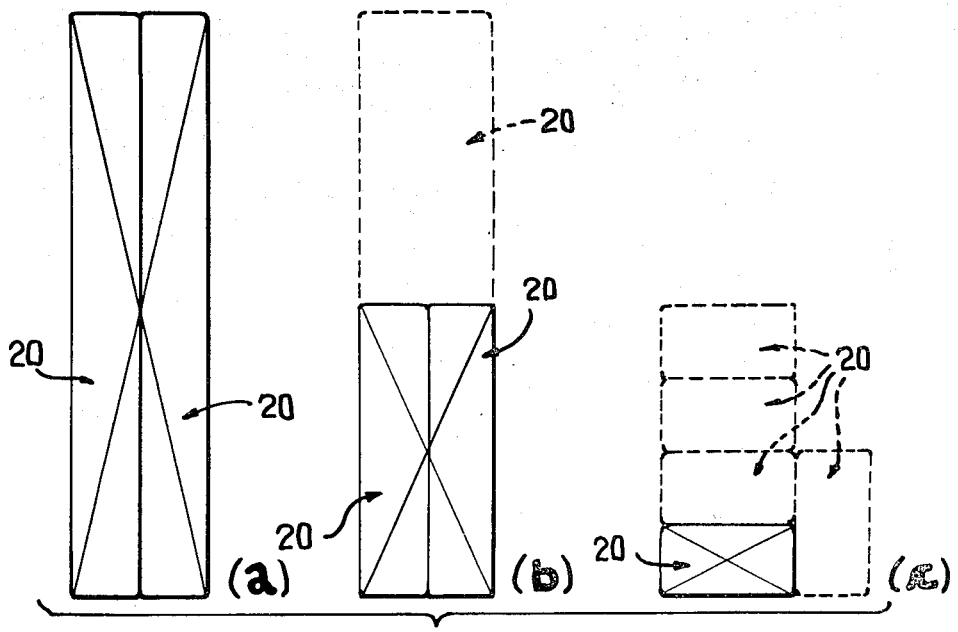
FIG.2

FIG.3
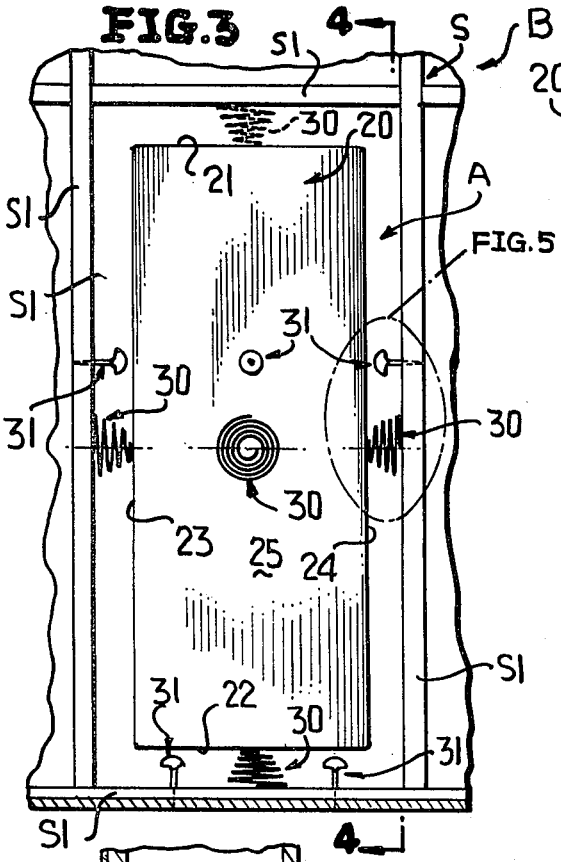
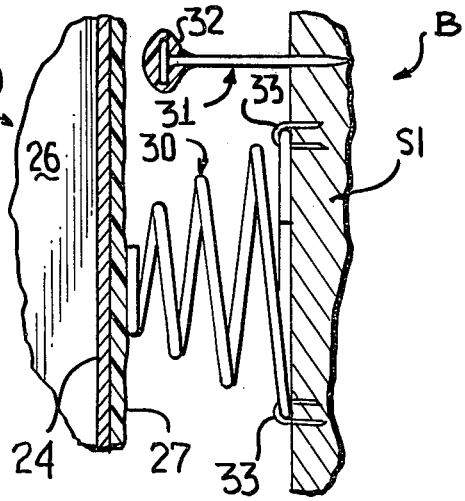
FIG.5
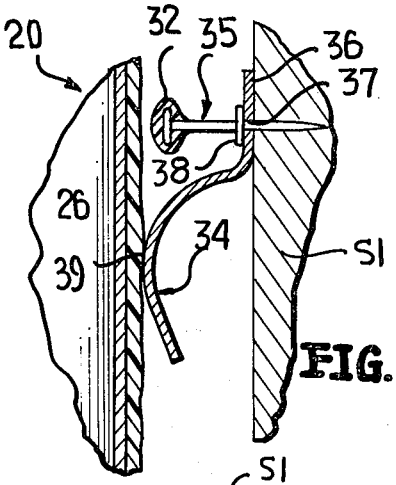
FIG.6
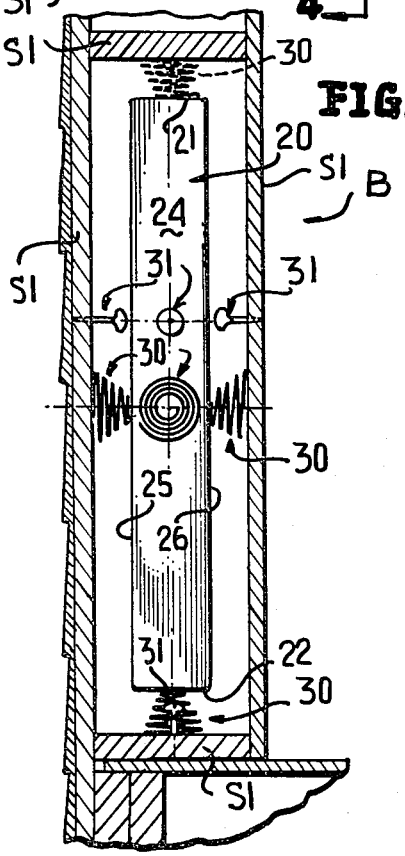
FIG.4
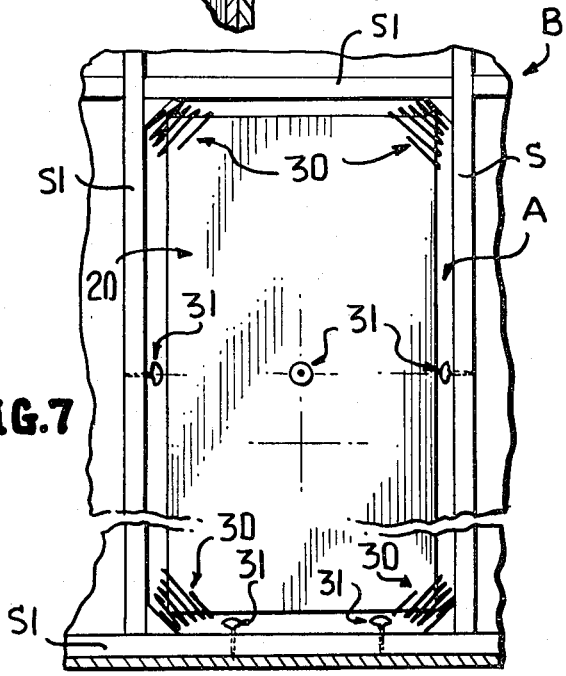
FIG.7

THERMAL INSULATING SYSTEM PARTICULARLY ADAPTED FOR BUILDING CONSTRUCTION

This application is a divisional application of copending application Ser. No. 215,083 in the name of Harrison G. Dyar, entitled Thermal Insulating System Particularly Adapted For Building Construction filed on Dec. 10, 1980 and issued on June 15, 1982 as U.S. Pat. No. 4,334,395.

It is relatively well known to insulate the walls, ceilings, floors and like structures of buildings with insulating material. Generally, the insulating material is provided in rolls, panels, or is simply of a flock-like nature such that it might be blown into the areas which are to be insulated. Prior to the recent escalation of fossel fuel costs and the attendant escallation of the cost of electricity, there was no particular advantage of utilizing slightly costlier though far more efficient insulation than that which has been heretofore provided. However, with the increase in heating costs, irrespective of the particular source of heat, it has become highly desirable to insulate buildings and like structures as effectively and as efficiently as possible, and it is to the latter end that the present invention is directed.

In keeping with the present invention, the walls, ceilings, floors or like structure of a building are insulated by utilizing a hollow insulating panel which includes an interior chamber under negative (vacuum) pressure which, of course, is known to be of extremely high thermal insulating qualities, as evidenced by conventional so-called "vacuum" jugs, bottles, containers or the like. A panel of the latter type is positioned in, for example, the area between the studs of a building wall, and a plurality of springs, chains, or like means are utilized for supporting the panel in spaced relationship to the associated building structure (studs). The springs, links or like flexible connectors contact the insulating panel only at limited exterior surface areas and, therefore, there is minimal thermal conduction between the insulating panel and the surrounding environment. A plurality of pin-like elements which might be conventional nails are positioned about the exterior of the panel in spaced relationship thereto, and the purpose thereof is to contact the panel only at limited exterior surface areas should the springs, links, or the like become inoperative which in the absence of the nails would result in direct contact between the insulating panel and the associated building structure, thus reducing the efficiency of the insulating panel.

In further keeping with this invention, a plurality of such insulating panels might be bonded or bound together to form a composite panel of a shape and size to fit a particular opening or area of a building structure. Thus, the individual insulating panels of this invention are formed in several different basic modular units of different peripheral outlines and/or sizes, and when selectively unitized, a composite insulating panel can be constructed therefrom to fit most any area of a building which is to be insulated.

In further accordance with this invention, the insulating panel is preferably utilized in conjunction with a flexible insulating sheet which projects beyond a peripheral outline of the insulating panel, thus defining a peripheral border which can be nailed, stapled or otherwise fastened to the building such that the normal space between the outer periphery of the insulating panel and the building structure can be closed to thermal transfer by convection.

Still another object of this invention is to provide a novel insulating panel in which in lieu of the insulating panel being mounted directly in a building structure with the springs and nails positioned between the building structure and the insulating panel, the insulating panel is instead mounted in spaced relationship in a slightly larger "container," and the pin-like elements (nails) and springs are utilized to maintain the insulating panel in spaced relationship to the container thus forming a prefabricated unit which can be shipped from the place of manufacture to the place of installation and thereat installed by simply placing the container within the area which is to be insulated.

With the above and other objects in view that will hereinafter appear, the nature of the invention will be more clearly understood by reference to the following detailed description, the appended claims and the several views illustrated in the accompanying drawings.

IN THE DRAWINGS:

FIG. 1 is a perspective view in schematic form illustrating the thermal installation system of the present invention, and illustrates a plurality of different sized areas which are insulated by insulating panels of this invention in the ceiling, walls, and floors of an associated building.

FIG. 2 is a schematic view of several basic modular units or insulating panels of the invention, and illustrates that different sizes and shapes might be formed and united to accommodate different sizes and shapes of areas which might be encountered in a building structure which is to be insulated.

FIG. 3 is a front elevational view of a novel insulating panel constructed in accordance with this invention, and illustrates the panel installed between studs of a building with the insulating panel being supported in spaced relationship to the building by coil springs, while pin-like elements or nails are fastened to the building but are in spaced relationship to the insulating panel.

FIG. 4 is a sectional view taken generally along line 4—4 of FIG. 3, and more clearly illustrates the spaced relationship of the insulating panel within the building structure.

FIG. 5 is an enlarged sectional view of the encircled portion of FIG. 3, and more clearly illustrates details of one of the coil springs, one of the nails or pin-like elements, and a coating of generally heat insulating or thermal insulating material carried by an end of the nail in spaced relationship to an insulating coating on the exterior of the insulating panel.

FIG. 6 is a fragmentary view similar to FIG. 5, but illustrates the manner in which a leaf spring is utilized instead of a coil spring for contacting a limited exterior surface area of an insulating panel and holding the same in spaced relationship to the associated building structure.

FIG. 7 is a fragmentary front elevational view similar to FIG. 3, and illustrates coil springs located at the corners of an evacuated insulating panel for holding the panel in spaced relationship to an associated building structure.

Figure 8:
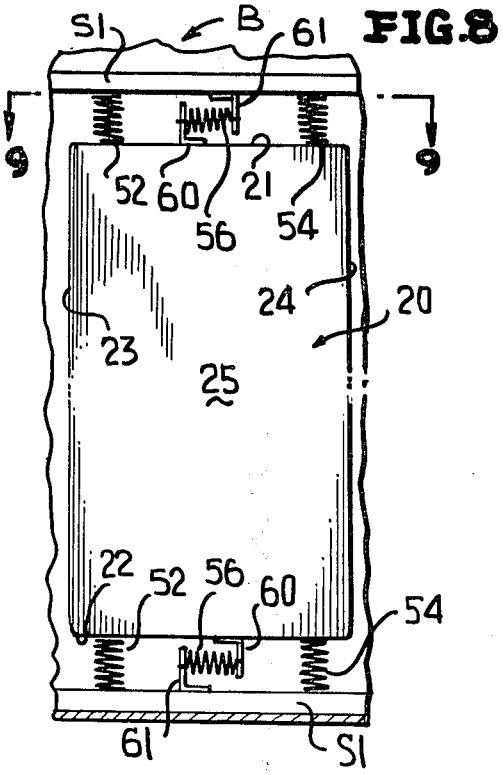
FIG. 8 is a fragmentary front elevational view of another embodiment of this invention, and illustrates an evacuated insulating panel supported relative to building structure by a plurality of the coil springs.

Reference is first made to FIGS. 1 and 2 of the drawings which illustrates applicant's novel thermal insulating system which is generally designated by the reference numeral 10 (FIG. 1) and is shown installed in a building B which includes a roof R beneath which is a conventional ceiling C, side walls S and a conventional floor F. The building B includes conventional rafters, studs, joist or the like, all of which are unnumbered, which define areas and/or volumes of different sizes and shapes which are conventionally insulated by, for example, inserting roll or batt insulation between internal dry wall and external siding of a conventional building. In lieu of the latter, the present thermal insulating system 10 includes a variety of different types of insulating panels which are generally designated collectively by the reference numeral 20 in FIG. 1 and might be of a variety of different peripheral sizes, shapes or the like such that individual panels or modular units 20 might be sized exactly to fit in a particular area which is to be insulated into building B or might be glued or otherwise secured together in a plurality of different ways to form different shapes to accommodate different areas of the building B which is to be insulated, in the manner shown in FIG. 2. For example, in FIG. 2*a* two insulating panels 20, 20 are shown in side-by-side relationship. The panels 20, 20 of FIG. 2*a* are glued or otherwise bonded together and when used in duplicate, they can, of course, insulate an area generally twice the size of one of the single panels 20 of FIG. 2*a*. Likewise, in FIG. 2*b* the panels 20, 20 thereof might be half the size of the panels 20, 20 of 2*a* and thus utilized to insulate an area of the building B half the size which might be insulated by the panels 20, 20 of FIG. 2*a*. Of course, another pair of panels, as shown in phantom outline in FIG. 2*b*, can also be bonded to the panels 20, 20 to in effect insulate through utilizing four panels in area identical to that which might be insulated by the two panels 20, 20 of FIG. 2*a*. FIG. 2*c* merely indicates that the panels 20 might be smaller and adhere to each other in most any fashion necessary to insulate any particular area of the building B.

Reference is now made to FIGS. 3 through 5 of the drawings which more specifically illustrate one of the panels 20 of FIGS. 2*a* through 2*c*, and in this embodiment of the invention, the panel 20 includes a top wall 21, a bottom wall 22, a pair of narrow end walls 23, 24, and a pair of side walls 25, 26. The walls 21 through 26 are covered with an external layer of insulating material 27 (FIG. 5) and the walls 21 through 26 define a generally hollow interior or chamber 28 which is under negative pressure (vacuum). The panel 20 is shown in FIG. 3 installed within a general rectangular area or volumn A of the wall S of the building B between the conventional studs or studding S1 thereof. The panel 20 is, of course, not only spaced from the bounding studs or studding S1 but is also spaced from the wallboard or interior wall and the exterior sheathing or siding (unnumbered). Obviously, since the interior or chamber 28 of the insulating panel 20 is under negative or vacuum pressure, the same is of extremly high thermal insulating quality and by thus installing the plurality of panels 20 in the building B, as shown in FIG. 1, the building B can be extremely efficiently insulated so long as, of course, the panels 20 are essentially held in spaced relationship to the walls, studs, rafters, beams, etc. of the building B such that virtually all thermal conduction is precluded or substantially lessened.

In order to support each of the hollow evacuated insulating panels 20 in essentially total spaced relationship from the studs S1 or like structure of the building B, means generally designated by the reference numeral 30 in the form of coil springs are disposed between each of the walls 21 through 26 and each of the adjacent surfaces of the building B such that larger ends of the springs 30 contact the studs S1 while smaller ends of the springs 30 contact very limited exterior surface areas of the panels 21 through 26. Thus, even if the springs 30 are formed of metallic or like thermal conductive material, the limited contact between the springs 30 and the various walls 21 through 26 assures that there is minimal thermal conduction or transfer between the panels 20 and the building B. However, the springs 30 are preferably constructed from plastic or similar material which has extremely low thermal conductive characteristics (heat insulating and cold insulating). Under most circumstances, six springs 30 are different to support each of the hollow evacuated insulating panels 20 from the associated building structure, although in the embodiment of the invention illustrated in FIG. 3, the uppermost spring 30 shown in phantom outline may, if desired, be eliminated.

Means generally designated by the reference numeral 31 are provided in normally spaced relationship from the exterior surface of the panel 20 and, of course, the insulating material or coating 27 thereupon in the manner best illustrated in FIG. 5. The individual means 31 are each a plurality of elongated pin-like elements of relatively small cross-sectional configuration whereby thermal conduction transfer therethrough is substantially negligible. These pin-like elements 31 might simply be nails which are driven into the studs S1 and if constructed from metallic or like high heat conductive and cold conductive material, they might have thereon a coating 32 (FIG. 5) of plastic or like heat or cold insulating material. The purpose of the means or pin-like elements 31 is to contact a limited exterior surface area of the panel 20 only upon any of the springs 30 breaking or loosing their resilience and thus becoming inoperative to maintain the panel 20 spaced from the surrounding studding S1 which in the absence of the pin-like elements 31 would result in direct contact between the panel 20 or the insulation 27 thereon and the associated building wall or studs S1 and thus decrease efficiency of the insulating panels 20. For example, if the lowermost spring 30 in FIG. 3 were to break and the pin-like elements 31 to each side thereof were nonexistent, the bottom wall 22 would contact the lower stud S1 and quite possibly if the panel 20 were to cock or cant, it might contact others of the studs S1 and thereby increase thermal conductivity and thus decrease the efficiency of the panel 20. However, in keeping with the present system 10, the panel 20 is normally maintained in its operative position (FIG. 3) such that all of its walls 21 through 26 are spaced from adjoining portions, walls, studs S1 or the like of the building B, and should any of these springs 30 become inoperative or fail for any purpose, the pin-like elements 31 will assure that the panel 20 will not in fact contact portions of the building B and instead will at the very most contact the limited headed ends or coatings 32 of selected ones or less of the pin-like elements 31. In this fashion, an extremely highly efficient insulating panel 20 is created which assures that thermal conduction, be it hot or cold, is maintained at an optimum under any particular conditions.

Referring specifically to FIG. 5, the pin-like elements 31 are illustrated as being headed nails, but these may in turn be screws, power-driven rivits, or the like. Likewise, any conventional means may be utilized to secure the coil springs 30 to the building B or the studding S1 thereof, as, for example, standard metallic or plastic staples 32.

Reference is made to FIG. 6 of the drawings which illustrates two modifications of the system 10 thus far described relative to FIGS. 3 through 5, namely, the utilization and substitution of a leaf spring 34 for each of the springs 30 and the utilization and substitution of a double-headed pin-like element or nail 35 for each of the pin-like elements 31 of FIGS. 3 through 5. The leaf spring 34 includes a terminal mounting end 36 having a bore or aperture 37 through which passes the nail 35 for holding the leaf spring 34 on the studding S1 through a head 38 of the nail 35 medialy the ends thereof. The leaf spring 34 has a curved end portion 39 which, of course, contacts very limited surface areas of the insulation 27 and/or any one of the walls 21 through 26 of the insulating panel 20. Thus, the overall structure of FIG. 6 can be utilized in lieu of each spring 30 and pin-like element 31 of FIG. 5 in a manner readily apparent from this description.

Reference is now made to FIG. 7 which again illustrates an identical insulating panel 20 with the exception that the springs 30 are positioned at corners (unnumbered) of the panel 20 and due to this arrangement, it is unnecessary to position springs 30 in contact with the walls 25 and 26 of the panel 20 of FIG. 7. Thus, four springs can be utilized in the embodiment shown in FIG. 7 as opposed to the five or six springs 30 of the embodiment or installation of FIG. 3. Of course, the pin-like elements 31 are also utilized in connection with the system of FIG. 7.

Figure 9:
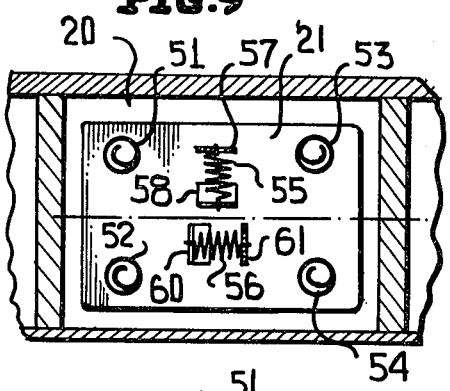
FIG. 9 is an enlarged fragmentary sectional view taken generally along line 9—9 of FIG. 8, and illustrates a pair of springs whose axes are generally normal to each other additionally connecting the panel to an associated building structure.
Figure 10:
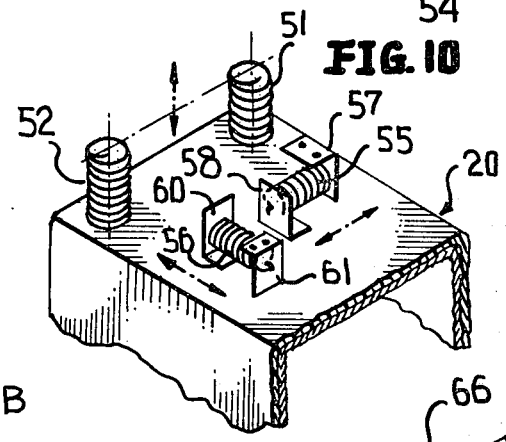
FIG. 10 is a perspective view of a portion of the installation of FIGS. 8 and 9, and more clearly illustrates the relationship of the plurality of the springs associated with the insulating panel.

Reference is now made to FIGS. 8 through 10 of the drawings which illustrate the system 10 including a panel 20 thereof which is mounted or supported relative to studs S1 of the building B in a manner somewhat different than that heretofore described. In the case of the embodiment of the invention shown in FIGS. 8, 9 and 10 of the drawings, the side walls 23, 24 of the panel 10 of FIG. 8 are totally unsupported, although pin-like elements corresponding to pin-like elements 31 might be associated with these walls as well as with the bottom wall 22 and the side walls 25, 26. However, in this case, the panel 20 is preferably supported at its top and at its bottom by four springs which in FIG. 9 are numbered 51 through 54 and like springs 52, 54 are also shown in FIG. 8 below the bottom wall 22 of the panel 20 and, of course, unillustrated springs corresponding to the springs 51, 53 are also located beneath the bottom wall 22. The springs 51 through 54 above the top wall 21 and below the top wall 22 function, of course, just as do the springs 30 in FIG. 3. However, in lieu of the elements 31 or 35, two additional springs 55, 56 are located adjacent the top wall 21 and the bottom wall 22 of the insulating panel 20 of FIGS. 8 through 10. The springs 55, 56 are positioned with their axes generally normal to each other and ends (unnumbered) of the springs 55, 56 are connected to respective brackets 57, 58 and 60, 61. The springs 55 therefor resist motion parallel to the axis of the springs 55 whereas the springs 56 resist motion parallel to the axis of the same springs 56. Thus, the panel 20 of FIGS. 8 through 10 is supported in the spaced position illustrated best in FIGS. 8 and 9 by virtue of the springs 51 through 56 preferably in the absence of any further springs or in the absence of any of the elements 31 and/or 35, although as noted earlier, the latter-noted elements may be included, if so desired.

Figure 11:
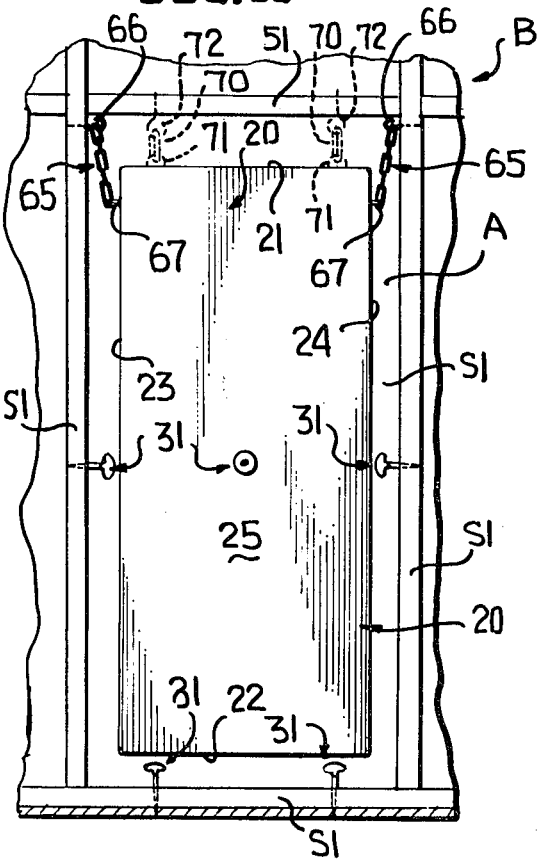
FIG. 11 is a fragmentary front elevational view of another evacuated insulating panel constructed in accordance with this invention, and illustrates the same being suspended by chains or a plurality of articulately interconnected links with pin-like elements or nails disposed in spaced relationship to the insulating panel.
Figure 12:
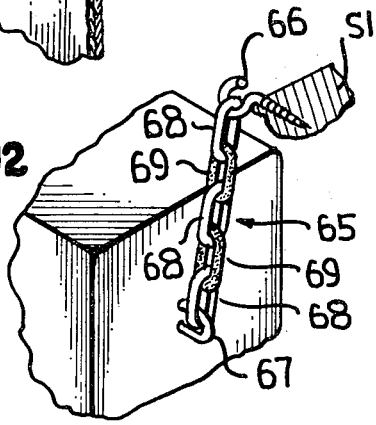
FIG. 12 is a fragmentary perspective view showing one of the chains or articulately interconnected links, and illustrates several of the links being constructed from thermal insulating material.
Figure 13:
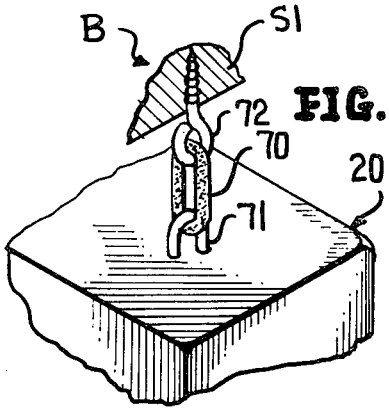
FIG. 13 is a fragmentary perspective view of one of the two individual links shown in phantom outline in FIG. 11, and illustrates a single link of thermal insulating material connecting the insulating panel to an associated building structure.

Reference is now made to FIGS. 11 through 13 of the drawings in which another of the hollow evacuated insulating panels 20 as illustrated in conjunction with pins or pin-like elements or nails 31. However, in lieu of any of the compression springs heretofore described, the panel 20 of FIGS. 11 and 12 is suspendingly supported by means in the form of flexible connectors 65 which are simply articulated links or chains hung from or connected between eyes 66, 67 secured to the studs or studding S1 and the panel 20, respectively. The articulated chains or links 65 (FIG. 12) may be constructed entirely of metallic links, but preferably the same are each constructed from a plurality of metallic links 68 and nonmetallic links 69 (plastic) which have relatively low thermal conductive properties. Thus, there is extremely limited contact between each conductive link 68 and the associated eyes 67 and/or 66, but, more importantly, the nonthermally conductive links 69 virtually preclude the conduction of heat or cold between the panel 20 and the associated building B or the stud or studding S1 thereof.

FIG. 13 illustrates a modification of the system 10 of FIGS. 11 and 12 wherein a simple thermally non-conductive link 70 is connected between eyes 71, 72 which are in turn conventionally connected to the panel 20 and the studding S1 of the building B. The system of FIG. 13 might, of course, preferably be utilized in pairs, as shown in phantom outline in FIG. 11, in lieu of or in addition to the flexible connecting means 65 of this same figure.

Figure 14:
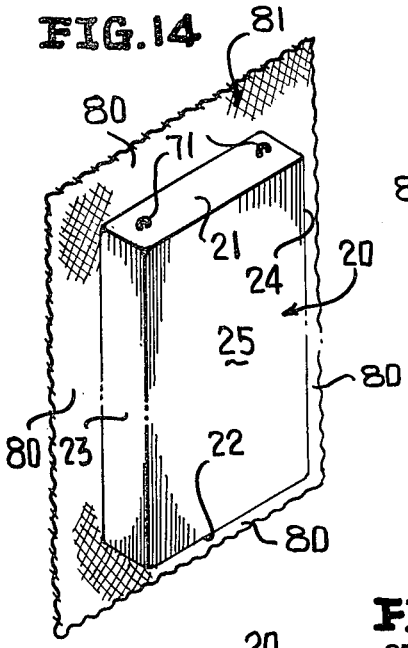
FIG. 14 is a perspective view of a hollow evacuated insulating panel of the type heretofore illustrated and further shows a sheet of flexible insulating material bonded to the panel and projecting as a border about its periphery.
Figure 15:
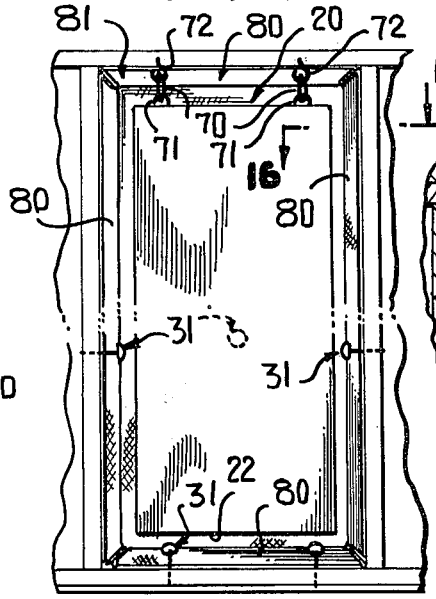
FIG. 15 is a fragmentary front elevational view illustrating the insulating panel of FIG. 14 in its installed position with the flexible border being stapled or nailed to the building structure.
Figure 16:
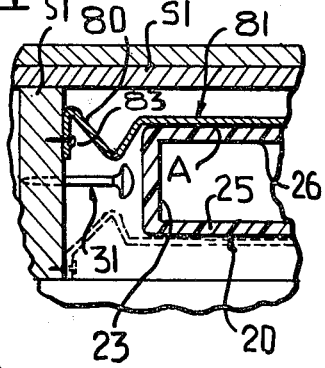
FIG. 16 is a fragmentary sectional view, slightly enlarged taken generally along line 16—16 of FIG. 15, and more clearly illustrates the manner in which the flexible insulating material is stapled, nailed or otherwise secured to the building structure.

FIG. 14 represents another modification of the heat insulating system 10 wherein the panel 20 is constructed once again as a hollow panel whose interior is under negative pressure (vacuum), and the same is provided with hooks or eyes 71, just as shown in FIG. 13 for suspending the panel 20 of FIG. 14 in association with the building B of FIGS. 15 and 16. However, in the case of the panel 20 of FIGS. 14 through 16, one or both of the walls 25, 26 has adhesively bonded thereto by adhesive B (FIG. 16) a flexible sheet of insulating material which projects beyond the walls 21, 22, 23 and 24 thereby defining a peripheral border 80 of the overall flexible insulating sheet which is generally designated by the reference numeral 81. A sheet identical to the sheet 81 may also be bonded to the wall 25 as indicated by the sheet 82 shown in phantom outline in FIG. 16. The purpose of the insulating sheets 81 and/or 82 is to further prevent the transfer of cold or hot air between the outside and the inside of the building B or between opposite sides of walls associated therewith, as is readily apparent from FIGS. 15 and 16. To this end, the panel 20 is mounted, as is readily apparent in FIG. 15, with the wall 26 of the panel 20 being spaced from but adjacent to the outside wall of the building B. The wall 25 of the panel 20 is more inboard than the wall 26 and is, therefore, adjacent to what would amount to be the plasterboard walls inside a conventional home or building. Once the panel 20 has been supported in the manner shown in FIG. 15, the border 80 of the flexible insulating sheet 81 is secured by staples, tacks, nails, or the like about the entire periphery of the area which is to be insulated by securing the staples, nails, or the like, which are generally designated by the reference numeral 83 to the studding S1 or like building structure. Obviously, if the panel 20 includes the flexible insulated sheeting or sheet 82, the border 80 thereof is likewise fastened by staples, nails or the like 83 to the studding S1. Furthermore, if desired, conventional insulating material might be placed in the area between the borders 80, 80 of the respective sheets 81, 82 before the border of the sheet 82 is nailed in position to thereby fully insulate the boundary or annular chamber defined between the peripheral walls 21 through 24 of the panel 20, the studding S1 surrounding these walls, and two borders 80, 80 of the sheets 81, 82.

Figure 17:
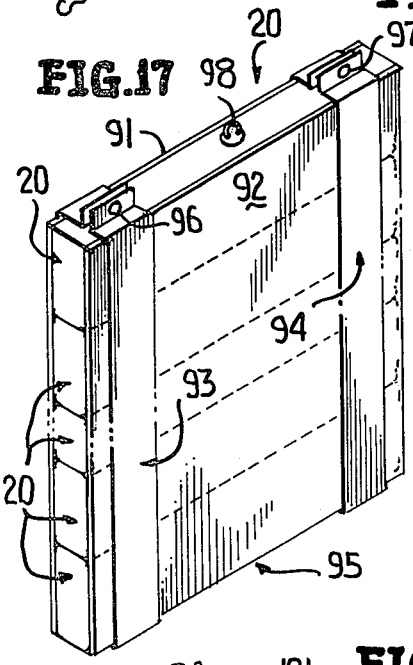
FIG. 17 is a perspective view of a composite insulating panel constructed in accordance with this invention, and illustrates a plurality of different sized individual insulating panels or modular units, of the type shown in FIG. 2, held together by a pair of panels and associated bands.
Figure 18:
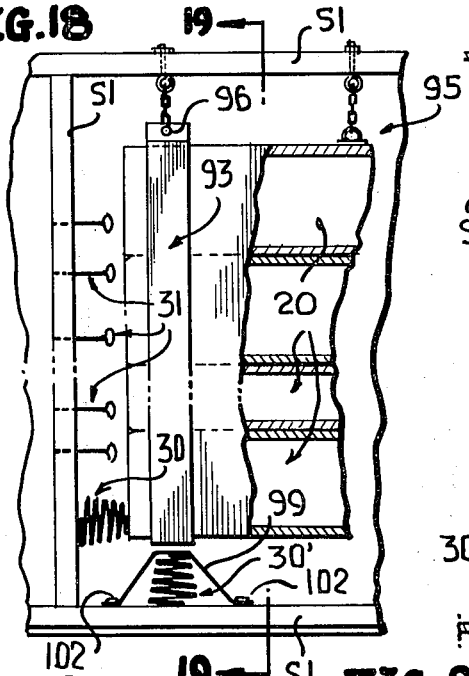
FIG. 18 is a fragmentary front elevational view, and illustrates the composite insulating panel of FIG. 17 installed in a building structure with a lowermost spring being held out of contact with a lowermost of the insulating panels in lieu of utilizing a pin-like element or nail thereat.
Figure 19:
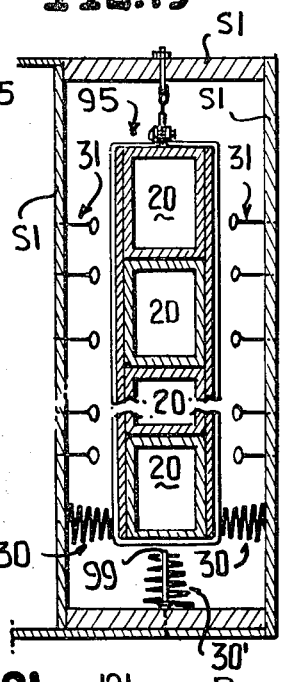
FIG. 19 is a sectional view taken generally along line 19—19 of FIG. 18, and illustrates the manner in which the composite insulating panel is maintained in overall generally total spaced relationship to the associated building structure.

Reference is now made to FIGS. 17 through 19 of the drawings wherein in a plurality of panels 20 which are identical to the panels heretofore described are stacked one atop the other in sandwich relationship between a pair of generally rectangular sheets of insulation 91, 92 which are in turn wrapped by a pair of bands 93, 94 to form a composite insulating panel 95. Terminal ends (unnumbered) of the bands 93, 94 are provided with openings 96, 97, respectively, which might be utilized to suspend a composite insulating panel 95 in an associated building in the manner clearly illustrated in FIGS. 18 and 19. Another eye 98 connected to the uppermost insulating panel 20 may also be utilized to suspend the composite panel 95 from the uppermost stud or studding S1 of the building B in the manner most clearly illustrated in FIG. 18 of the drawings. In FIG. 18 and 19, the composite insulating panel 95, is of course, associated with the coil springs 30 and the pin-like elements 31 heretofore described while a lowermost spring 30' is utilized beneath the composite panel 95 in lieu of the pin-like elements or headed nails 31. The spring 30' is located at the lowest corner of the composite insulating panel 95 and a like spring (not shown) is located at the opposite unillustrated lowermost corner of the same composite panel 95. The spring 30' and the other unillustrated spring is held in a slightly compressed position in spaced relationship to the lowermost insulating panel 20 by a metallic band 99 which is in partial overlying and spanning relationship to the coil spring 30' and is fastened at its end to the lowermost studding S1 by nails or tacks 102. The springs 30' are, therefore, utilized in lieu of the pin-like elements or nails 31 such that the springs 30' are normally in spaced relationship to the lowermost one of the panels 20, but should the composite panel 95 drop downwardly for some reason, the lowermost panel 20 will be contacted by the spring 30' or the other spring (unillustrated), and thus prevent the composite panel or any portion thereof from contacting the studding S1 on anything other than a very limited areawise basis.

Figure 20:
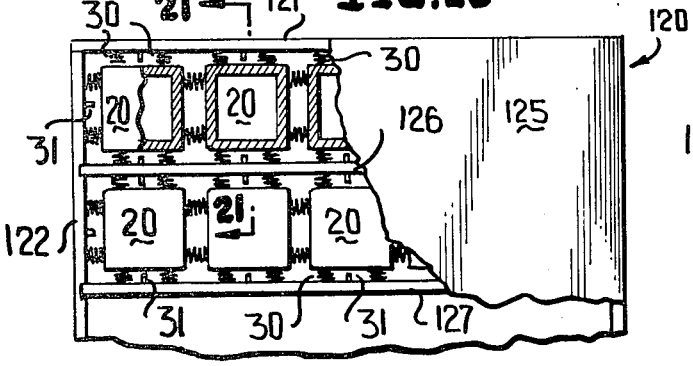
FIG. 20 is a fragmentary cross-sectional view of another insulating panel constructed in accordance with this invention, and shows a plurality of individual insulating panels or modules supported in spaced relationship to the interior of an enclosing container or housing.
Figure 21:
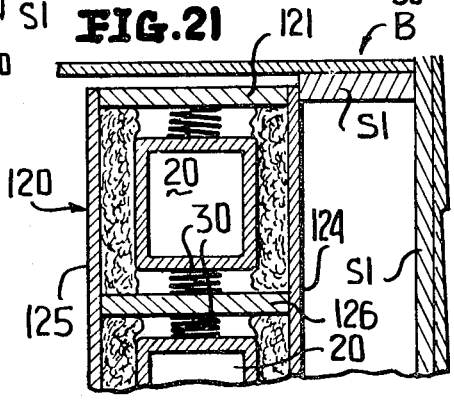
FIG. 21 is a fragmentary sectional view taken generally along line 21—21 of FIG. 20, and illustrates the container or housing with the insulating panels therein bodily positioned with an area of a building which is to be insulated.

Reference is now made to FIGS. 20 and 21 of the drawings wherein a number of insulating panels 20 are illustrated housed within an exterior container which is generally designated by the reference numeral 120. The exterior container 120 includes a top wall 121, a bottom wall (unnumbered) parallel to and spaced from the top wall 21, a pair of end walls 122, 123, a rear wall 124 and a top wall 125. If a plurality of the panels 20 are housed within the container 120, a plurality of shelves or intermediate walls 126, 127 might be positioned within the container 20. However, the container 20 might house within its internal chamber only a single one of the panels 20, and the springs 30, and pin-like elements or nails 31 associated therewith. In this embodiment of the invention, the entire container 120 is fabricated at the point of manufacture in the manner illustrated in FIG. 20, shipped to an on-site location, and installed within a building wall, ceiling, floor or the like by simply inserting the container 120 into the area to be insulated. The latter insulation is best shown in FIG. 21 wherein the entire container 20 is shown inserted within an area of the building B inboard of the external siding (unnumbered). This essentially constitutes a prefabricated construction such that the springs 30 and the pin-like elements 31 need not be stappled, nailed, or otherwise secured to the studs or studding S1 in the manner heretofore described. Instead, the container 120 is merely inserted in its position of use, as shown in FIG. 21. If, for example, the peripheral dimensions of the area into which the container 120 is to be inserted measures two feet by four feet, the exterior peripheral dimensions of the container 120 would be so dimensioned and, thus, would readily fit into the two-by-four area/volume. Obviously, in a container 120 of the latter size, a plurality of the hollow evacuated panels 120 need not be utilized but in lieu thereof, a single panel 20 would be supported within the container 120 by the springs 30 and pin-like elements 31 associated therewith and, of course, the overall peripheral dimension of the single hollow evacuated insulating panel would be slightly smaller than the internal dimensions of the overall container 20 sufficient, of course, to accommodate the spring 30 and pin-like elements 31. If desired, the interior of the container 20 might also include insulating material I, in the manner also shown in FIG. 21.

Although only a preferred embodiment of the invention has been specifically illustrated and described herein, it is to be understood that minor variations may be made in the apparatus without departing from the spirit and scope of the invention, as defined in the appended claims.

What is claimed is:

1. A system for insulating building walls, ceilings, floors or like structures comprising wall means for forming a hollow insulating panel defining an interior chamber under negative pressure, said panel having a plurality of upper and lower corners, means contacting a limited exterior surface area of said panel for supporting said panel in generally spaced relationship from an associated building wall, ceiling, floor or like structure, means normally spaced from the exterior surface of said panel for contacting a limited exterior surface area of said panel only upon said first-mentioned contacting means becoming inoperative which would in the absence of said second-mentioned contacting means result in direct contact between said panel and the associated building wall, ceiling, floor or like structure, said second-mentioned contacting means being an elongated pin-like element of relatively small cross-sectional configuration whereby thermal conduction transfer therethrough is substantially negligible, said first-mentioned means being a plurality of flexible connectors each defined by a plurality of interconnected links, and a flexible connector being disposed adjacent each of said upper corners.

2. The insulating system as defined in claim 1 wherein the elongated pin-like element is disposed between said lower corners.

3. The insulating system as defined in claim 1 wherein said second-mentioned contacting means includes another elongated pin-like element of relatively wall cross-sectional configuration whereby thermal conduction transfer therethrough is substantially negligible, and said first-mentioned and another elongated pin-like elements are disposed between said lower corners.

4. The structure system as defined in claim 1 wherein at least one of said links of each flexible connector is formed of relatively low thermal conductive material.

5. The insulating system as defined in claim 2 wherein at least one of said links of each flexible connector is formed of relatively low thermal conductive material.

6. The insulating system as defined in claim 3 wherein at least one of said links of each flexible connector is formed of relatively low thermal conductive material.

* * * * *